US008134064B2

(12) United States Patent
Sanns, Jr.

(10) Patent No.: US 8,134,064 B2
(45) Date of Patent: Mar. 13, 2012

(54) METHOD OF IMPROVING SOUND QUALITY OF A MUSICAL INSTRUMENT

(76) Inventor: Frank Sanns, Jr., Pittsburgh, PA (US)

( * ) Notice: Subject to any disclaimer, the term of this patent is extended or adjusted under 35 U.S.C. 154(b) by 173 days.

(21) Appl. No.: 12/686,662

(22) Filed: Jan. 13, 2010

(65) Prior Publication Data

US 2011/0167991 A1 Jul. 14, 2011

(51) Int. Cl.
*G10H 3/00* (2006.01)
*G10D 9/00* (2006.01)

(52) U.S. Cl. ..... 84/723; 84/453

(58) Field of Classification Search ..... 84/723, 84/453, 454, 294
See application file for complete search history.

(56) References Cited

U.S. PATENT DOCUMENTS

| | | | | |
|---|---|---|---|---|
| 2,911,872 | A | 11/1959 | Carl | |
| 4,649,793 | A * | 3/1987 | Blackshear et al. | 84/453 |
| 5,537,908 | A * | 7/1996 | Rabe et al. | 84/454 |
| 5,600,081 | A | 2/1997 | Simjian | |
| 7,227,068 | B1 * | 6/2007 | Van Doren | 84/297 R |
| 7,678,987 | B2 * | 3/2010 | Lye | 84/723 |
| 7,932,457 | B2 * | 4/2011 | Hall et al. | 84/723 |
| 7,968,779 | B2 * | 6/2011 | Courtright et al. | 84/320 |
| 7,977,555 | B2 * | 7/2011 | Hall et al. | 84/291 |
| 7,977,565 | B1 * | 7/2011 | Lye | 84/723 |
| 2007/0175320 | A1 | 8/2007 | Hall et al. | |
| 2008/0289483 | A1 * | 11/2008 | Hall et al. | 84/723 |
| 2009/0229445 | A1 * | 9/2009 | Courtright et al. | 84/453 |
| 2010/0112368 | A1 * | 5/2010 | Ishida et al. | 428/542.8 |
| 2011/0167991 | A1 * | 7/2011 | Sanns, Jr. | 84/723 |

* cited by examiner

*Primary Examiner* — Jeffrey Donels
(74) *Attorney, Agent, or Firm* — McNees Wallace & Nurick LLC

(57) ABSTRACT

An apparatus and method are disclosed for artificially aging a musical instrument is provided. The apparatus and method include oscillating the sound board of the instrument by an energy source at specific frequencies over the playing frequency range of the instrument.

20 Claims, 2 Drawing Sheets

METHOD OF IMPROVING SOUND QUALITY OF A MUSICAL INSTRUMENT

FIELD

The present disclosure is generally directed to acoustics, and is more particularly directed to an apparatus and method for improving the sound quality of acoustic instruments.

BACKGROUND

It is well known that some acoustic stringed instruments have a more pleasing sound as they age. This invention is a method to produce remarkable tonal and volume improvements that can take years or decades to develop if they can naturally develop at all. The process by which sound from some acoustic stringed instruments improvers with playing is known variously as breaking in, aging and/or conditioning. New or little-used instruments are characterized by tones and volume that lack sustaining power, depth, volume and clarity of well-used and/or aged instruments. Although not wishing to be bound by any theory, sound may improve as an instrument is played due to the sustained transmission of vibrations from the instrument's strings to the wooden sounding board of the instrument and the effects of these vibrations on the structure and mechanical characteristics of the wood and the instrument finish.

There is a need for an effective apparatus and method for treating an acoustic instrument to impart aged properties.

SUMMARY OF THE DISCLOSURE

In an exemplary embodiment, a method for conditioning a musical instrument is disclosed that includes providing a musical instrument, coupling one or more energy sources to a sound board of the musical instrument, wherein the one or more energy sources are configured to induce oscillations in a sound forming surface of the musical instrument.

In another exemplary embodiment, a musical instrument is disclosed that is conditioned by a method including providing a musical instrument, coupling one or more energy sources to a sound board of the musical instrument, wherein the one or more energy sources are configured to induce oscillations in a sound forming surface of the musical instrument.

In yet another exemplary embodiment, an apparatus for conditioning a musical instrument is disclosed that includes one or more energy sources. The one or more energy sources are configured to induce oscillations at a selected location on a sound forming surface of the musical instrument.

Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to represent the same parts.

DETAILED DESCRIPTION

Figure 1:
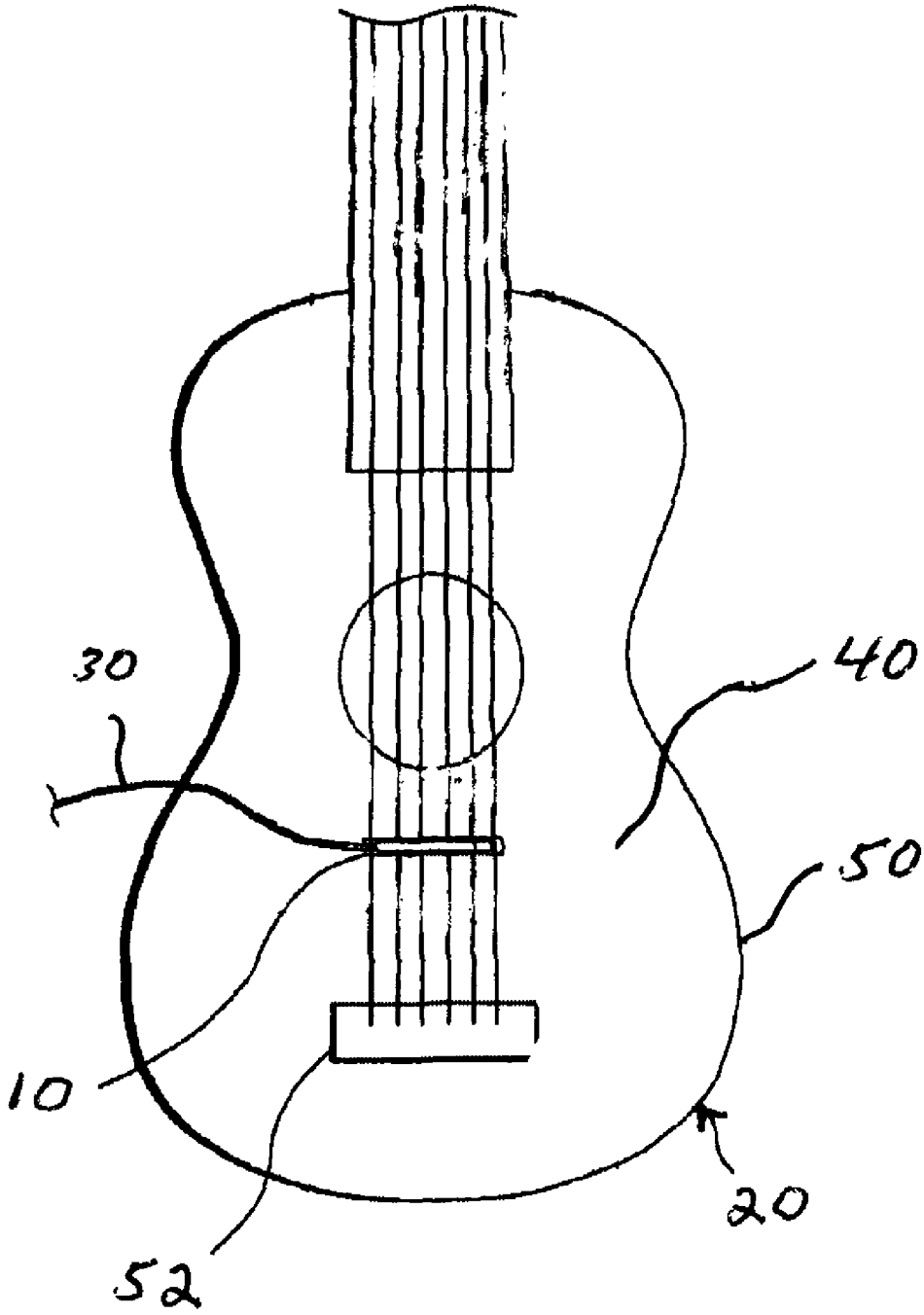
FIG. 1 is top view of an embodiment of the conditioning device attached to a stringed instrument.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Embodiments of the present disclosure provide for a system and method for transmitting energy to an instrument to oscillate or vibrate the instrument in a manner to effect the acoustic properties of the instrument. In one embodiment the present disclosure provides for a system and method for transmitting vibrational energy to a wooden, acoustic instrument to oscillate or vibrate the instrument in a manner to effect the acoustic properties of the instrument. As used herein, the term wooden, acoustic instrument (instrument) refers to any musical instrument that produces sound by means of vibrating strings and the instrument includes a wooden sound board, such as, but not limited to those in the guitar, mandolin, violin families. For example, the acoustic instrument may be an acoustic guitar, violin, cello or bass. Further as used herein, the term acoustic properties includes, but are not limited to tonal quality and complexness (richness), responsiveness, resonant amplitude (volume), articulation and dynamic range. As a result of applying the disclosed process to an instrument, an instrument will have improved tonal quality and complexness, responsiveness, increased resonant amplitude, increased dynamic range and articulation. Application of the disclosed process to an instrument may be referred to as conditioning the instrument.

According to one embodiment of the disclosure, energy may be input to the instrument by direct coupling an energy source to the main sound forming surface(s) of the instrument, by indirect coupling the source via air immediately adjacent to the sound forming surface(s) instrument, by interface coupling the source to a liquid or polymeric material between the source and the sound forming surface(s) of the instrument, and any combination thereof. The energy source provides a forced oscillation of the instrument's sound forming surfaces that cause a relaxation of structural memory of the wood. In the case of the instrument being a guitar or violin, the sound forming surface of the instrument is the top surface of the instrument. Although no wanting to be bound by a particular theory, it is believed that the structural memory develops and remains in the wood from the time the wood grew from a tree, hereinafter referred to as tree memory. The forced oscillation causes a new memory to develop, hereinafter referred to as audio vibrational memory, in the wood that favors musical notes and accompanying harmonic complexities. The loss of tree memory and the gain of audio vibrational memory allows the sound forming surfaces of the instrument to acquire aged wood instrument characteristics. These aged wood instrument characteristics include, but not limited to, the ability of the instrument to require less input energy (energy required to excite a string) for a similar volume output, resulting in less fatigue to a player.

According to an embodiment of the disclosure, an apparatus is disclosed that includes an energy source capable of generating or inducing oscillations of a specific frequency or frequency range in an instrument. The energy source is configured to induce oscillations in a sound forming surface of an instrument. The energy source may be a mechanical, electromechanical, pneumatic, hydraulic or similar oscillating source. In one embodiment, the apparatus includes an electric frequency generator coupled to a electromechanical transducer. The energy source is configured to produce energy over the frequency range of the instrument being treated. In one embodiment, the energy source is configured to produce frequencies of the range of notes capable of being played by the musical instrument. For example, for a standard size acoustic guitar having a musical range of E2 to E6, the energy source is configured to be capable of imparting a frequency range of about 82.4 Hz (E2) to about 1,318.5 Hz (E6), which corresponds to the chromatic notes of the equal-tempered scale of the guitar.

In one embodiment, the energy source is coupled to and inputs energy into the sounding board of the instrument. The energy source inputs energy of a specific frequency or frequency range to cause the sound forming surfaces to move with greater deformation than would result from normal playing of the instrument. As a result, the instrument characteristics are changed to that of an aged instrument, that is for the sound surfaces to oscillate more freely when the notes of the instrument are played naturally. The instrument may be monitored during energy application or input. For example, a monitoring system may be used to monitor the forced oscillations of the instrument. The monitoring system may include, but is not limited to, low mass accelerometers/transducers, optical and/or high speed photography techniques, holography, and laser profilometers.

The energy input to the instrument by this process is greater than the energy input during normal playing of the instrument. It is important to note that the energy is input to the sound forming surfaces of the instrument and through the strings According to an embodiment of the disclosure, the apparatus inputs energy at a rate of between about 0.01 joule/meter$^2$ up to about 500 joule/meter$^2$. According to another embodiment of the disclosure, the apparatus inputs energy at a rate of between about 10 joule/meter$^2$ up to about 300 joule/meter$^2$. The energy input to the instrument is chosen to cause the desired frequency oscillation of the sound board of the instrument without risking damage to the instrument, and will depend upon the physical characteristics of the instrument, such as, but not limited to joint strength and sound board thickness. In one embodiment, the energy input is monitored and adjusting during energy input in response to the observed oscillations of the sound board. The observed oscillations may be used to position one or more energy sources at one or more locations upon or proximate to the sound board in order to optimize the oscillations of the sound board. The oscillations of the sound board may be monitored by optical and/or acoustic measurement of the oscillations. In one embodiment, energy is input to the top surface of the sound board. In another embodiment, energy is input to the substantial symmetric center of the sound board. In yet another embodiment, energy is input into another wooden structure or element of the instrument, such as a back structure.

In an embodiment of the disclosure, the energy source inputs energy over the frequency range of the instrument into the instrument during one or more sessions. Sessions are separated by predetermined rest periods. In one embodiment, the rest periods may be one or more hours. In another embodiment, the rest periods may be one or more days. In another embodiment, the rest periods may be between about 1 day and about 4 days. In yet another embodiment the rest periods may be between about 1 day and about 2 days.

Each session includes a predetermined number of cycles. In one embodiment, a session may include 1 to 12 cycles. In another embodiment, a session may include 2 to 10 cycles. In yet another embodiment, a session may include 3 to 6 cycles. In still another embodiment, a session may include 3 to 4 cycles. The term cycle is used herein to mean applying energy at a each note over the scale of the instrument for a predetermined period of time. In one embodiment, a cycle may include the energy source inputting energy into the instrument for about 5 to about 30 seconds for each note. In another embodiment, a cycle includes the energy source inputting energy for about 10 to about 20 seconds for each note. In yet another embodiment, a cycle includes the energy source inputting energy for about 15 seconds for each note.

According to an embodiment of the disclosure, the energy source is directly coupled to the instrument. The energy source may be a mechanical, electromechanical, pneumatic, hydraulic or similar oscillating power source. In one embodiment, the power source may be an oscillator. The energy source may be directly coupled to the sound board of the instrument. In the case of a guitar or violin, the sound board is usually the top surface of the instrument. In an embodiment, the energy source may be directly mechanically attached to the sound board, bridge, strings near the bridge, or through the bridge pin holes. The energy source may be mechanically attached by bolting, clamping or otherwise affixing the source to a surface in direct physical contact with the sound board. In another embodiment the attached adhesively to the primary vibrating surface of the instrument.

FIG. 1 shows an embodiment of the disclosure having an energy source 10 directly coupled to an instrument 20. In this exemplary embodiment, the instrument 20 is a guitar. Furthermore, in this embodiment, the energy source 10 is an electromechanical transducer (transducer). The transducer 10 is attached to a power source (not shown) via a cable 30 or other similar connection. The power source may be an electric frequency generator configured to produce frequencies of the range of notes capable of being played by the instrument 20. In another embodiment, the transducer 10 may be wirelessly connected to the power source.

As shown in FIG. 1, the transducer 20 is positioned or located at a selected location or position on a surface 40 of front face or sound board 50 of instrument 50. The transducer 20 is positioned between the bridge 52 and sound hole 54. In another embodiment, the transducer 20 may be positioned at other locations on the surface 40 of the soundboard 50, and/or more than one transducer 20 may be used. The number, size and positioning of the transducer 20 is selected to maximize the oscillation of the soundboard 50. In other words, the number, size and positioning of the transducer 20 is selected to maximize the deflection or excursion of the surface 40. The number, size, positioning and energy input of the transducer 20 may be monitored and/or adjusted when placing and energizing the one or more transducers on the surface 40 to achieve the maximum oscillation of the surface while not damaging the instrument 20.

According to another embodiment of the disclosure, the energy source is indirectly coupled to the instrument. The energy source may be a mechanical, electromechanical, pneumatic, hydraulic or similar oscillating power source. In one embodiment, the power source may be an oscillator. According to this embodiment, the energy source is located proximate to the sound board of the instrument. In this embodiment, energy is transmitted via air from the energy source to the sound board. In one embodiment, the energy source is located proximate to the sound board by placing the oscillating source approximately 15 cm from the sound board.

According to yet another embodiment of the disclosure, the energy source is interface coupled to the sound board. The energy source may be a mechanical, electromechanical, pneumatic, hydraulic or similar oscillating power source. In one embodiment, the power source may be an oscillator. In one embodiment, the energy source is coupled to the sound board via a fluid and/or elastic material intermediate to the energy source and the primary vibrating surface of the instrument i.e. sound board. In one embodiment, a mechanical, electromechanical, pneumatic, hydraulic or similar oscillating source is brought in physical contact with the coupling fluid and/or elastic material, which in turn is brought in physical contact with the primary vibrating surface of the instrument. In yet embodiment, the physical contact is made with a secondary vibrating surface of the instrument, such as the instrument back.

The oscillations induced from direct, indirect and/or interface coupling may be selected to achieve the desired tonal and volume improvements to the instrument. This is done by selecting the waveform, amplitude, and location of the input oscillatory vibrations. Although best results are obtained with oscillation input to the primary vibrating surface of the instrument, it is also possible to input the oscillations through other portions of the instrument to effect other characteristics of the instrument. In one embodiment, inputting energy into the primary sound board of a violin e.g. the front surface, may also effect the characteristics of the back surface, which also vibrates. This may occur since the back of the violin is directly coupled to the top of the violin via the sound post and/or side walls.

It is also recognized that some primary surface vibrations are not moving up and down in unison (low frequency torsion modes). This may be accommodated with this invention by choosing appropriate locations for the input oscillations to be applied (i.e. on one side of the primary vibrating surface instead of the symmetrical center.

In one embodiment, the amplitude, frequency and location of the energy input is determined to produce the desired induced oscillations to the vibrational surface. The current disclosure provides for specific regions of the sound producing, i.e. vibrational, surfaces to be affected. It is important to note that, normal playing and/or a decade or more of physical aging of an instrument cannot produce the same results as can be achieved through application of the instant disclosure. This invention causes excursions of the sound forming surfaces in excess of what is possible by normal or even very aggressive (high forces) plucking or bowing of the strings.

Figure 2:
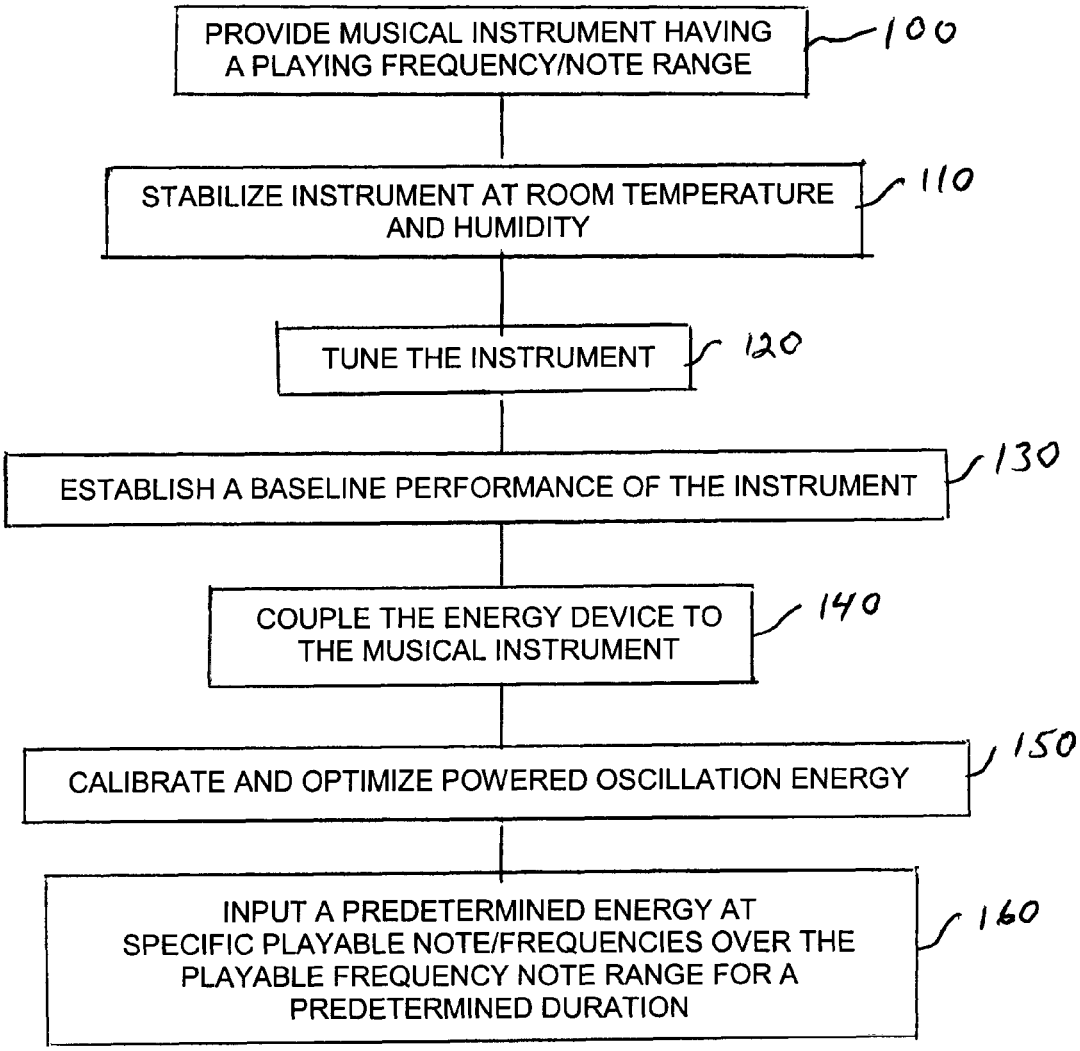
FIG. 2 is a flow diagram of an exemplary method of practicing the disclosure.

FIG. 2 is a flow diagram for of an exemplary embodiment of the disclosure. As shown in FIG. 2, a first step 100 includes providing an instrument and allowing the instrument to equalize for a predetermined time in a enclosure at a constant temperature and humidity. In an embodiment, the first step includes providing a guitar. In another embodiment, the first step further includes allowing the guitar to equalize in a room at a constant temperature and humidity for between about 24 to about 48 hours.

A second step 110 includes stabilizing the instrument. The instrument is stabilized by maintaining the instrument at a substantially constant temperature and humidity for a sufficient period of time for the instrument to hold a tune. In one embodiment, the temperature of the instrument is maintained at a temperature between about 65° F. and about 80° F.

An optional third step 120 includes tuning the instrument to a standard tuning. In one embodiment, the instrument is a guitar tuned to EADGBE i.e the notes associated with the guitar open string positions. In most circumstances, tuning of the instrument is preferred in order to provide a the baseline condition.

A fourth step 130 includes establishing a baseline performance of the instrument by attaching transducers to the bridge and/or areas of the instrument coupled to the sound board. In one embodiment, the third step 120 further includes audio recording the instrument as each of the six strings are plucked in the open position (EADGBE), with standard force of 100 grams to 500 grams. Furthermore, the temperature of the instrument may be adjusted and stabilized while establishing the baseline performance to optimize the excursions of the vibrating surface for a desired energy input.

A fifth step 140 includes attaching or coupling one or more energy sources to the instrument by direct coupling and/or indirect coupling. In one embodiment, the energy source is an oscillating source, and the oscillating source is directly coupled or indirectly coupled proximate to the sound board of the guitar. In one embodiment, the energy source is located proximate to the sound board of a guitar by placing the oscillating source approximately 15 cm from the sound board.

A sixth step 150 includes calibrating and optimizing the one or more energy sources. The calibration and optimization of powered oscillation energy is established since all instruments are braced differently, are made of different materials, are of different sizes, and have different thickness top, back and sides. This is done by starting low powered oscillations one at a time of the one or more energy sources, at frequencies that correspond to each of the open strings (EADGBE). The number of energy sources, energy source position, and power of the oscillations are adjusted to give approximately equal excursions of each the open strings to determine the slope of the frequency curve for this particular instrument. The excursion of the sound board is monitored while performing the adjustments. The energy input may be increased uniformly and adjusted to further determine the response of the instrument. This assures each string will respond with similar ease by the player when the process has been completed.

The baseline is further performed for each semitone of the instrument. For a standard guitar, the baseline is performed for each semitone of the common Western equal temperament scale. This assumes the fretboard of the instrument is perfectly tempered and that the A note is 440 Hz. All irregularities caused by physical effects of the string mass are neglected.

A seventh step 160 includes increasing the intensity of the powered oscillations to the desired levels for each semitone of the of the instrument. For example, when the instrument is a standard size guitar, to the common Western equal temperament scale. The typical frequency range for a standard size acoustic guitar is 82.4 Hz (E2) to 1,318.5 Hz (E6). In one embodiment, energy is input for each tone for about 5 to about 30 seconds. In another embodiment, energy is input for about 15 seconds for each semitone. Higher frequencies may be input, even into the ultrasonic region (>20,000 Hz), in order to provide for higher harmonics or relaxation of structural tree memory. Each performance of the sixth step 150 may be referred to as a cycle.

One or more cycles are performed to provide a session includes a predetermined number of cycles. In one embodiment, a session may include 1 to 12 cycles. In another embodiment, a session may include 2 to 10 cycles. In yet another embodiment, a session may include 3 to 6 cycles. In still another embodiment, a session may include 3 to 4 cycles. In one embodiment, a cycle may include the energy source inputting energy into the instrument for about 5 to about 30 seconds for each note. In another embodiment, a cycle includes the energy source inputting energy for about 10 to about 20 seconds for each note. In yet another embodiment, a cycle includes the energy source inputting energy for about 15 seconds for each note.

One or more sessions may be performed on the instrument. The period between the sessions is referred to as the rest period. In one embodiment, the rest period may be one or more hours. In another embodiment, the rest periods may be one or more days. In another embodiment, the rest periods may be between about 1 day and about 4 days. In yet another embodiment the rest periods may be between about 1 day and about 2 days.

Optionally, additional sessions may be added at any time in the future with some minor addition improvement is seen if a group of sessions is done a month or more later. Furthermore, the conditioning of the instrument can be performed without the instrument being strung or completely assembled.

According to an first example, a standard guitar having a standard string excursion (movement) of about 1 mm to about 3 mm under conventional playing style, with a maximum string excursion of about 4 mm with highly aggressive playing was provided. The 4 mm excursion imparts a force of about 500 grams, corresponding to a maximum energy of approximately 0.004 joules per pluck of the a string imparted to the instrument. A good portion of this energy is lost in a typical stringed instrument and consequently, the theoretical sound level output of approximately 93 db is never approached. For most standard guitars, the sound level is approximately 80 db to about 83 db for each note plucked under these conditions. After a conditioning of a standard guitar according to the process described above, the standard guitar volume is increased by about 3 db to about 6 db for each note plucked. A significant improvement results in the efficiency of the instrument to convert energy of the musician's movements into volume, dynamic range and tonal complexness (richness) projected from the instrument. It is important to note that lower power sources that input less or equal energy than normal aggressive playing of the instrument, will not work in any reasonable time frame or at all.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A method for conditioning a musical instrument, comprising:

providing a musical instrument;

coupling one or more energy sources to a sound board of the musical instrument; and inducing oscillations of a discrete semitone frequency of the musical instrument in a sound forming surface of the musical instrument.

2. The method of claim 1, wherein the one or more energy sources are directly coupled to the musical instrument.

3. The method of claim 1, wherein the one or more energy sources are indirectly coupled via air by placement proximate to the musical instrument.

4. The method of claim 1, wherein the one or more energy sources are interface coupled to the musical instrument.

5. The method of claim 1, wherein the energy source is selected from the group consisting of mechanical, electromechanical, pneumatic, and hydraulic oscillators.

6. The method of claim 1, wherein inducing oscillations further comprises the one or more coupled energy sources inducing oscillations into the musical instrument at each discrete semitone frequency of the musical instrument.

7. The method of claim 1, wherein the one or more energy source inputs energy of between about 0.01 joule/meter$^2$ to about 500 joule/meter$^2$ at each discrete semitone frequency of the musical instrument.

8. The method of claim 1, wherein the one or more energy source inputs energy of between about 10 joule/meter$^2$ to about 300 joule/meter$^2$ at each discrete semitone frequency of the musical instrument.

9. The method of claim 7, wherein the energy is input to the instrument for about 5 to about 30 seconds at each discrete semitone frequency of the musical instrument.

10. The method of claim 1, further comprising:

determining a coupling placement of the one or more energy sources to maximize oscillation of the sound board for a specific semitone frequency of the instrument.

11. The method of claim 1, wherein the musical instrument is a guitar.

12. A musical instrument conditioned by the method of claim 1.

13. An apparatus for conditioning a musical instrument, comprising:

one or more energy sources;

wherein the one or more energy sources are configured to induce oscillations of a discrete semitone frequency of the musical instrument at a selected location on a sound forming surface of the musical instrument.

14. The apparatus of claim 12, wherein the one or more energy sources are configured to be directly coupled to the musical instrument.

15. The apparatus of claim 12, wherein the one or more energy sources are configured to be indirectly coupled via air by placement proximate to the musical instrument.

16. The apparatus of claim 12, wherein the one or more energy sources are configured to be interface coupled to the musical instrument.

17. The apparatus of claim 12, wherein the energy source is selected from the group consisting of mechanical, electromechanical, pneumatic, and hydraulic oscillators.

18. The apparatus of claim 12, wherein the one or more energy sources are configured to induce oscillations into the musical instrument at each discrete semitone frequency of the musical instrument.

19. The apparatus of claim 12, wherein the one or more energy sources are configured to input energy of between about 0.01 joule/meter$^2$ to about 500 joule/meter$^2$ at each discrete semitone frequency of the musical instrument.

20. The apparatus of claim 12, wherein the one or more energy source inputs energy of between about 10 joule/meter$^2$ to about 300 joule/meter$^2$ at each discrete semitone frequency of the musical instrument.

* * * * *